US008531370B2

(12) United States Patent
Chen et al.

(10) Patent No.: US 8,531,370 B2
(45) Date of Patent: Sep. 10, 2013

(54) LIQUID CRYSTAL DISPLAY DEVICE WITH PIXEL STRUCTURE OF MULTIPLE THIN FILM TRANSISTORS AND OPERATING METHOD THEREOF

(75) Inventors: Yu-Yeh Chen, Tainan (TW); Feng-Sheng Lin, Tainan (TW); Ming-Feng Hsieh, Tainan (TW)

(73) Assignee: Chimei Innolux Corporation, Miao-Li Country (TW)

( * ) Notice: Subject to any disclaimer, the term of this patent is extended or adjusted under 35 U.S.C. 154(b) by 752 days.

(21) Appl. No.: 12/313,478

(22) Filed: Nov. 19, 2008

(65) Prior Publication Data

US 2009/0128472 A1 May 21, 2009

(30) Foreign Application Priority Data

Nov. 20, 2007 (TW) ..... 96143961 A

(51) Int. Cl.
*G09G 3/36* (2006.01)

(52) U.S. Cl.
USPC ..... 345/92

(58) Field of Classification Search
USPC ..... 345/92, 98, 102, 99, 90
See application file for complete search history.

(56) References Cited

U.S. PATENT DOCUMENTS

| | | | | |
|---|---|---|---|---|
| 4,907,862 | A | 3/1990 | Suntola | 345/88 |
| 6,181,311 | B1 * | 1/2001 | Hashimoto | 345/90 |
| 7,414,679 | B2 | 8/2008 | Tseng | 349/55 |
| 2005/0078076 | A1 * | 4/2005 | Kim et al. | 345/98 |
| 2005/0146490 | A1 * | 7/2005 | Kang et al. | 345/76 |
| 2008/0170022 | A1 * | 7/2008 | Chen et al. | 345/92 |
| 2008/0284701 | A1 * | 11/2008 | Fan-Chiang et al. | 345/90 |

FOREIGN PATENT DOCUMENTS

| | | |
|---|---|---|
| TW | 200720778 | 6/2007 |
| TW | 200735005 | 9/2007 |

OTHER PUBLICATIONS

Taiwan Intellectual Property Office, Office Action mailed Mar. 12, 2012 in Taiwanese application No. 5 510 22 2.
Chinese Patent Office, Office Action mailed Jan. 17, 2013 in Chinese application No. 200710196500.7.

* cited by examiner

*Primary Examiner* — Allison Walthall
(74) *Attorney, Agent, or Firm* — Trop, Pruner & Hu, P.C.

(57) ABSTRACT

A liquid crystal display (LCD) device and method for operating the device including, during a first time period, applying data from a data line to a capacitor included in a pixel and applying additional data from the data line to a capacitor included in an additional pixel. During a second time period, which follows the first time period, simultaneously applying the data to a liquid crystal capacitor included in the pixel and applying the additional data to a liquid crystal capacitor included in the additional pixel.

12 Claims, 15 Drawing Sheets

LIQUID CRYSTAL DISPLAY DEVICE WITH PIXEL STRUCTURE OF MULTIPLE THIN FILM TRANSISTORS AND OPERATING METHOD THEREOF

CROSS-REFERENCE TO RELATED APPLICATION

Pursuant to 35 U.S.C. §119, this application claims priority to Taiwan Application Serial No. 96143961, filed Nov. 20, 2007, the subject matter of which is incorporated herein by reference.

BACKGROUND

Color liquid crystal displays (LCD) may display colors by using a color filter and a white backlight source. When a white backlight source is not used, red, green, and blue light sources may be used. The red, green, and blue light sources may be rapidly switched on and off while liquid crystal patterns are changed. Consequently, the desired colors are displayed. This technique may be referred to the color sequential (CS) technique or as field sequential color (FSC) technology. The CS technique may divide one frame period into three sub-frame periods. The red, green, and blue light sources are sequentially switched on in respective different sub-frame periods to display corresponding image frames.

FIG. 1 shows a timing diagram for an FSC LCD. Each scan line in an LCD display is enabled via respective scan signals (Scan(1) to Scan(n)). Thus, the corresponding data signals (Data) are sequentially output to pixels of the LCD. Thereafter, the corresponding colors of the backlight units (BLU) are sequentially switched on to display image frames.

The CS technique, however, has deficiencies. For example, the sub-frame periods are short and the response times of liquid crystal molecules can be slow. Consequently, some part of the LCD panel may fail to reach a complete response state (i.e., desired brightness due to liquid crystal orientation changes) when different colored BLUs are turned on. Thus, some pixels may not reach the desired brightness.

DETAILED DESCRIPTION OF THE INVENTION

The following description refers to the accompanying drawings. Among the various drawings the same reference numbers may be used to identify the same or similar elements. While the following description provides a thorough understanding of the various aspects of the claimed invention by setting forth specific details such as particular structures, architectures, interfaces, and techniques, such details are provided for purposes of explanation and should not be viewed as limiting. Moreover, those of skill in the art will, in light of the present disclosure, appreciate that various aspects of the invention claimed may be practiced in other examples or implementations that depart from these specific details. At certain junctures in the following disclosure descriptions, well known devices, circuits, and methods have been omitted to avoid clouding the description of the present invention with unnecessary detail.

Figure 1:
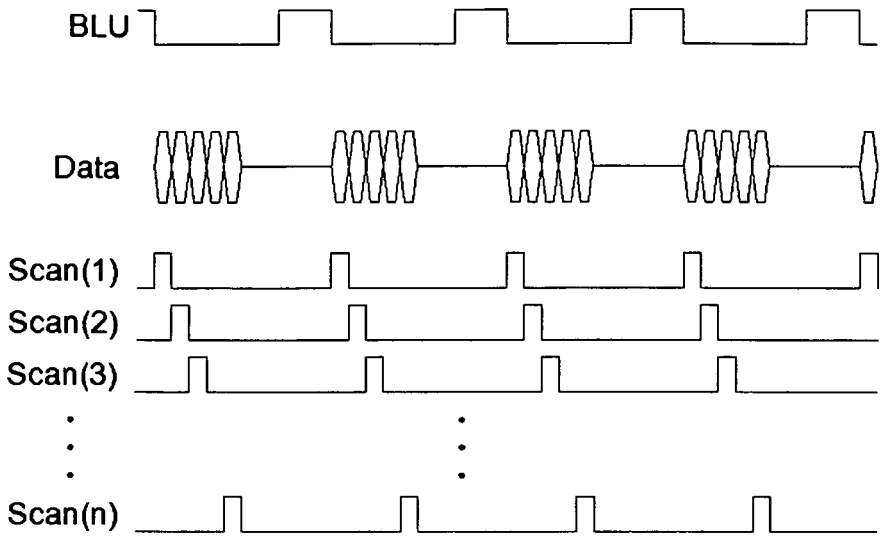
FIG. 1(PRIOR ART)
FIG. 1 is a timing diagram for a conventional FSC LCD device.
Figure 2:
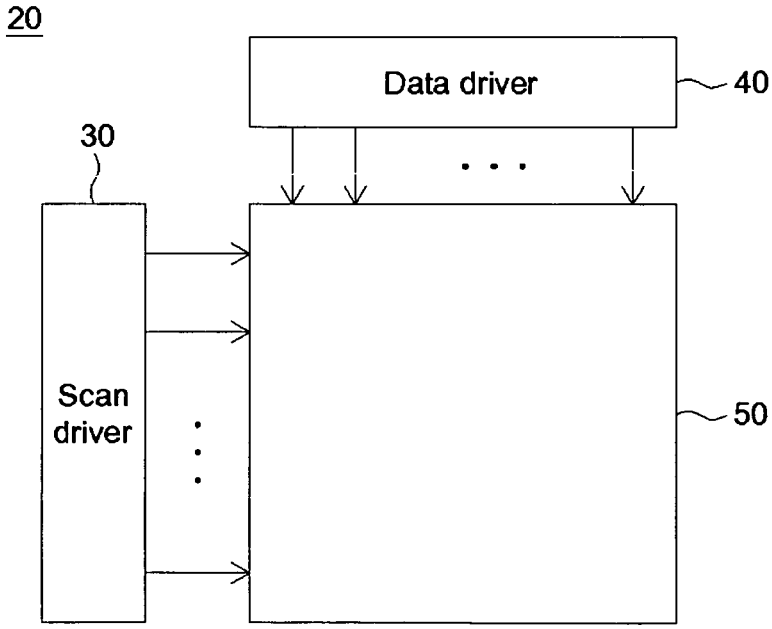
FIG. 2 is a schematic illustration of an LCD device according to an embodiment of the invention.
Figure 3:
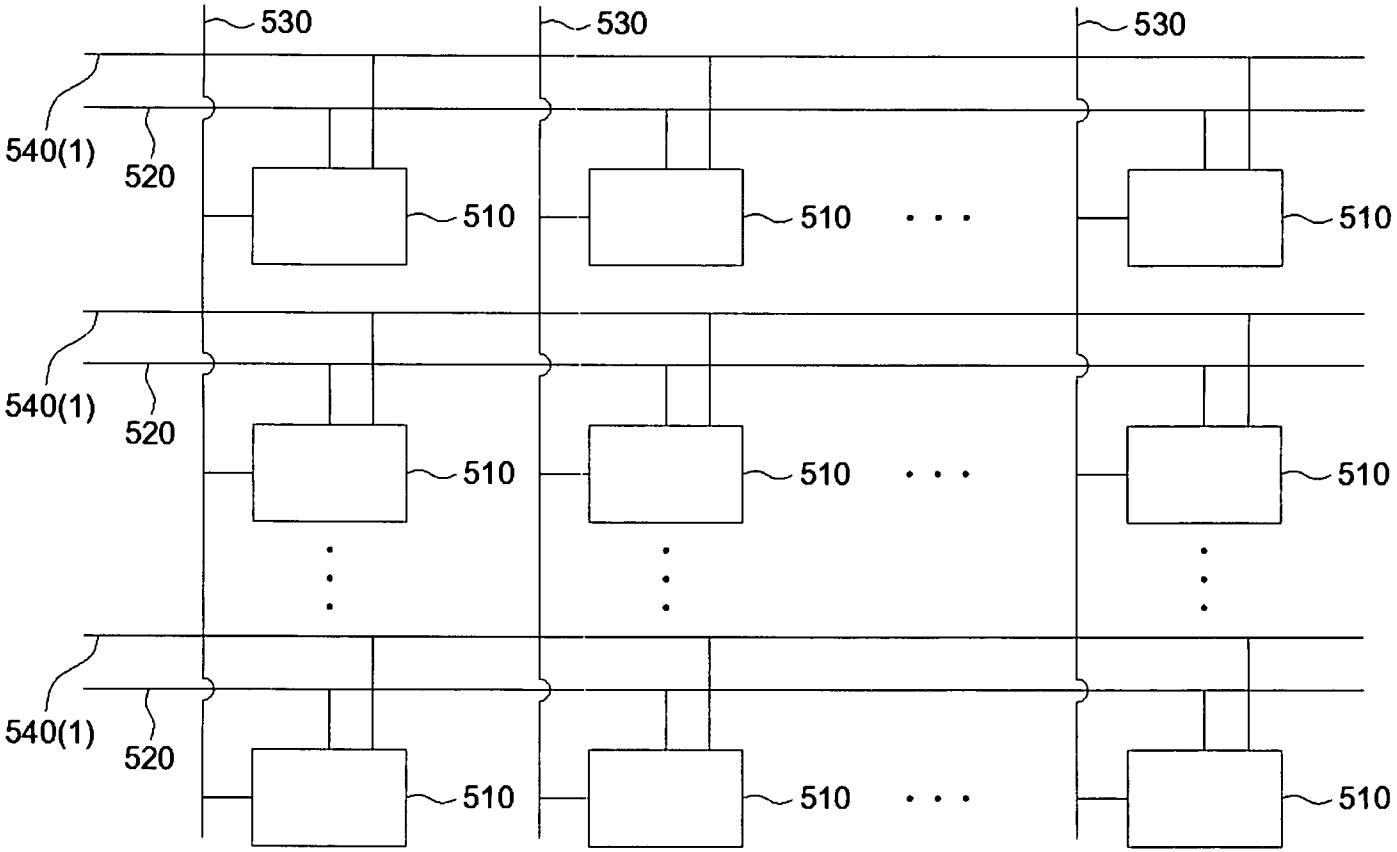
FIG. 3 is a schematic illustration of an LCD panel in the LCD above according to an embodiment of the invention.

FIG. 2 is a schematic illustration of a liquid crystal display (LCD) device 20 according to an embodiment of the invention. FIG. 3 illustrates an LCD panel in the LCD device 20. The LCD device 20 includes scan driver 30, data driver 40, and LCD panel 50. LCD panel 50 further includes pixels 510, scan lines 520, data lines 530, and signal outputting lines 540(1). Pixels 510 are arranged in M rows and N columns. Scan driver 30 outputs scan signals via scan lines 520 to sequentially enable M rows of pixels 510, and data driver 40 outputs corresponding data signals to N columns of pixels 510 via data lines 530.

Figure 4:
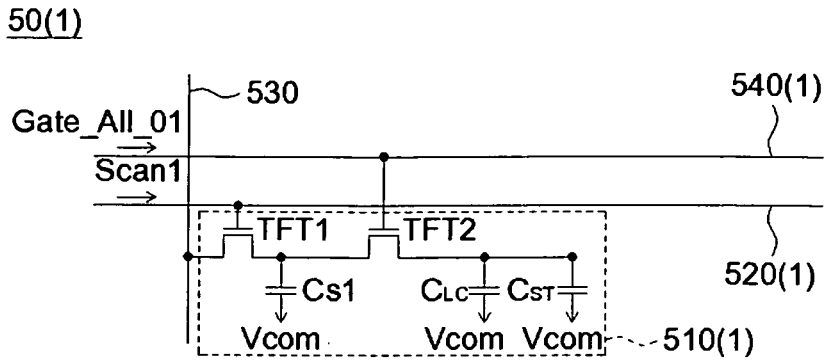
FIG. 4 is a schematic illustration of a portion of an LCD panel according to a first embodiment of the invention.

FIG. 4 is a schematic illustration of a portion 50(1) of an LCD panel according to a first embodiment of the invention. LCD panel 50(1) includes pixel 510(1), which further includes capacitor $C_{S1}$, switch TFT1, liquid crystal capacitor $C_{LC}$, storage capacitor $C_{ST}$, and switch TFT2. TFT1 and TFT2 switches may be, for example, thin film transistors (TFT). While switches may be labeled "TFT" herein, embodiments of the invention are not limited to using switches of any particular type. Furthermore, while pixels (e.g., 510(1)) are often discussed herein in their singular form, LCD panels often include more than one pixel.

The control terminals of switch TFT1 and switch TFT2 are respectively coupled to scan line 520(1) and signal outputting line 540(1). The first terminal of switch TFT1 is coupled to data line 530 and the second terminal of switch TFT1 is coupled to the first terminals of capacitor $C_{S1}$ and switch TFT2. The second terminal of switch TFT2 is coupled to the first terminals of liquid crystal capacitor $C_{LC}$ and storage capacitor $C_{ST}$. The second terminals of capacitor $C_{S1}$, liquid crystal capacitor $C_{LC}$, and storage capacitor $C_{ST}$ are coupled to common voltage Vcom (e.g., ground voltage).

Figure 5:
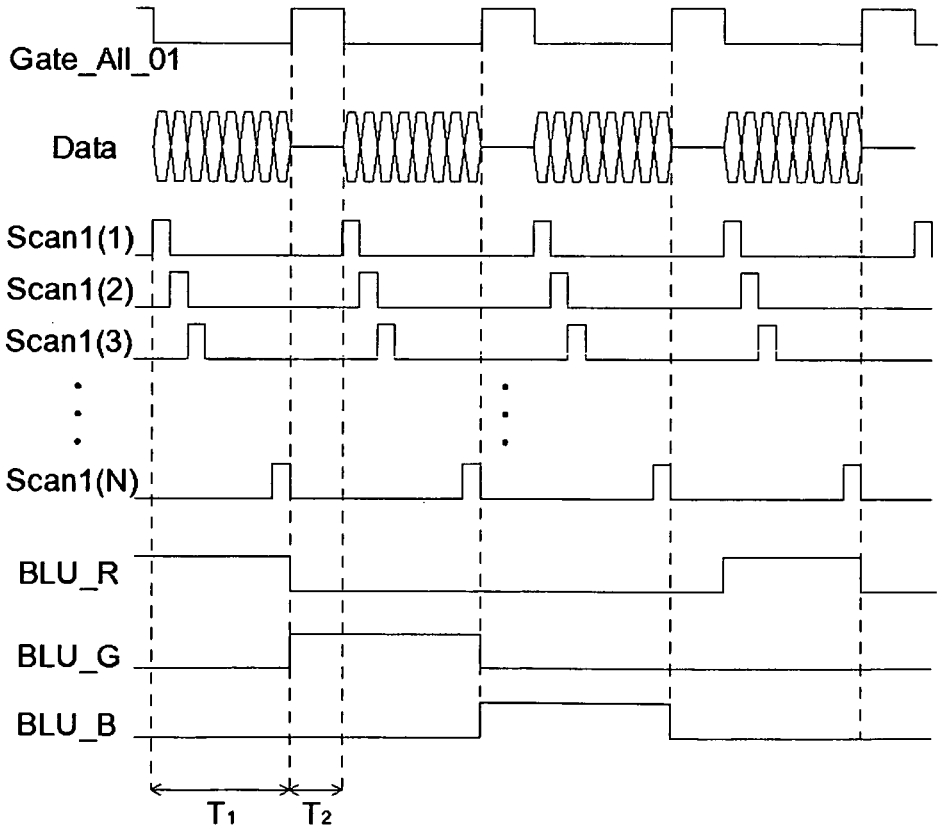
FIG. 5 is a timing diagram for an LCD panel according to the first embodiment of the invention.

FIG. 5 is a timing diagram according to the first embodiment of the invention. Scan driver 30 outputs scan signals Scan1(1) to Scan1(N). Scan signal Scan1 (FIG. 4), transmitted via line 520(1), is one of the scan signals included in the group Scan1(1) to Scan1(N) (FIG. 5). Scan signals Scan1(1) to Scan1(N) respectively and sequentially enable switches TFT1 of pixels 510(1) included in respective rows of pixels, during time interval T1, via scan line 520(1). Consequently, data signal Data, transmitted via data line 530, is applied to capacitor $C_{S1}$ via switch TFT1 of each respective pixel 510 (1).

Output signal Gate_All_01, transmitted via signal outputting line 540(1), synchronously (e.g., simultaneously), when activated, enables every switch TFT2 in panel 50(1) (or at least a portion thereof) during time interval T2. Consequently, data signal Data, stored in capacitors $C_{S1}$ in numerous pixels 510(1), may be simultaneously and respectively output to liquid crystal capacitors $C_{LC}$ in corresponding pixels 510(1) through switches TFT2 in every (or at least a portion thereof) row of pixels 510(1). For example, multiple switches TFT2 in corresponding multiple pixels may become enabled at the same time. In other embodiments of the invention, multiple switches TFT2 may not become enabled at the exact same time but they may still share a period of mutual enablement (e.g., a time period when two TFT2 switches are both in an enabled state) so that data is still deemed to be simultaneously output to liquid crystal capacitors $C_{LC}$ in numerous pixels 510(1). "Simultaneously" thus means that there is some overlapping time when multiple switches TFT2 are on. Simultaneously applying data to multiple LC capacitors through the corresponding TFT2 switches thus means that the data is applied to the multiple LC capacitors during the same time interval. Time interval T2 may include, for example, a blanking period of time for the LCD device. BLU_R, BLU_G, and BLU_B represent red, green, and blue backlight units. When the respective BLU_R, BLU_G, and BLU_B signal is high, that indicates the respective red, green, and blue backlight unit is activated.

Accordingly, the above embodiment of the invention synchronously applies data signal Data to liquid crystal capacitors $C_{LC}$ via numerous scan lines using scan signals Scan 1(1) to Scan 1(N). Thus, this may lessen adverse effects of using fast sub-frame periods associated with the FSC technology in conjunction with liquid crystal molecules having slower response times. Consequently, pixels throughout the LCD panel (e.g., top, middle, and bottom of panel) can attain a desired brightness.

Figure 6:
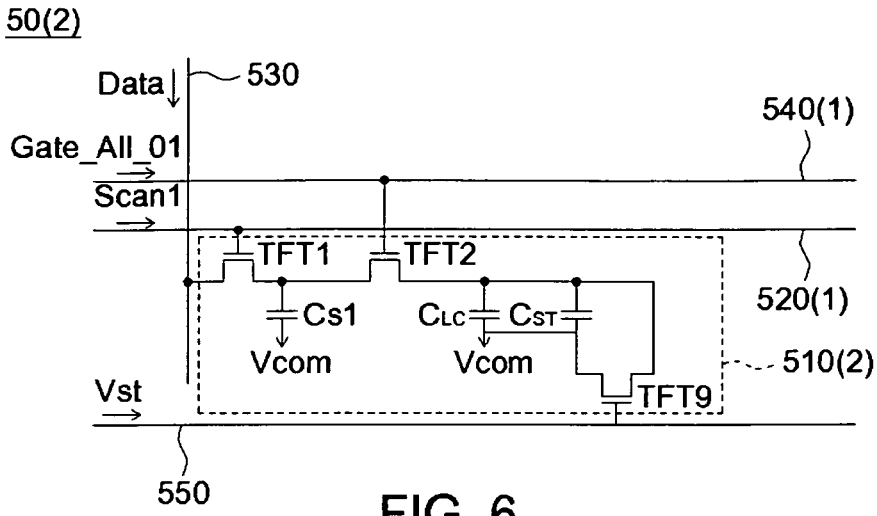
FIG. 6 is a schematic illustration of a portion of an LCD panel according to a second embodiment of the invention.

FIG. 6 is a schematic illustration of a portion 50(2) of an LCD panel according to a second embodiment of the invention. LCD panel portion 50(2) includes pixels 510(2). One difference between LCD panel 50(2) (FIG. 6) and LCD panel 50(1) (FIG. 4) is that, for example, LCD panel 50(2) and pixel 510(2) respectively further include reset signal line 550 and switch TFT9.

The first terminal and the second terminal of switch TFT9 are respectively coupled to the first terminal and the second terminal of liquid crystal capacitor $C_{LC}$, and the control terminal of switch TFT9 is coupled to the corresponding reset signal line 550. Switch TFT9 is controlled by reset signal Vst, transmitted via reset signal line 550, and is electrically connected to the first terminal and the second terminal of liquid crystal capacitor $C_{LC}$. This configuration resets the crossover voltage between the first terminal and the second terminal of the liquid crystal capacitor $C_{LC}$ when TFT9 is enabled.

Figure 7:
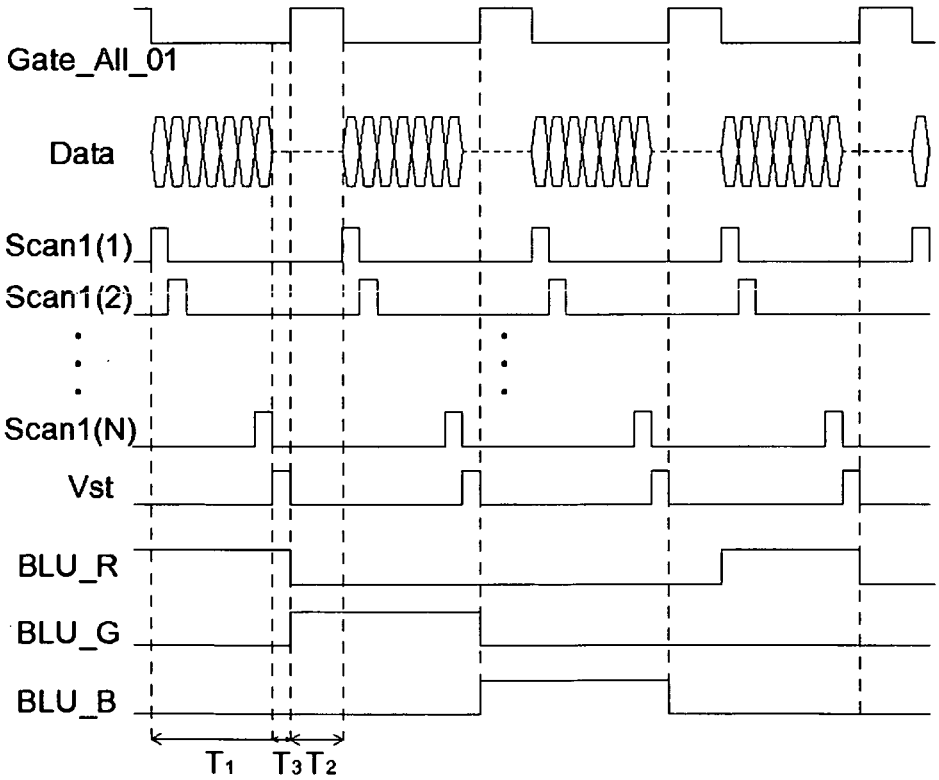
FIG. 7 is a timing diagram for an LCD panel according to the second embodiment of the invention.

FIG. 7 is a timing diagram according to the second embodiment of the invention described in association with FIG. 6. Reset signal Vst, transmitted via reset signal line 550, synchronously (e.g., simultaneously) enables all (or multiple) switches TFT9 (found in numerous pixels 510(2)), during time interval T3, to reset the crossover voltage between the first terminal and the second terminal of the liquid crystal capacitor $C_{LC}$ of each respective pixel. Effectively, the switch TFT9 when activated causes both terminals of capacitor $C_{LC}$ to be at $V_{COM}$. Time interval T3 may occur between time intervals T1 and T2. Each of time intervals T2 and T3 may be pair of, for example, a blanking period of the LCD device.

When the first terminal and the second terminal of liquid crystal capacitor $C_{LC}$ are electrically connected together during time interval T3, the data signals of previous frames stored in liquid crystal capacitor $C_{LC}$ and storage capacitor $C_{ST}$ may be cleared. Thus, the data signal charging time for the next frame may be shortened.

Figure 8:
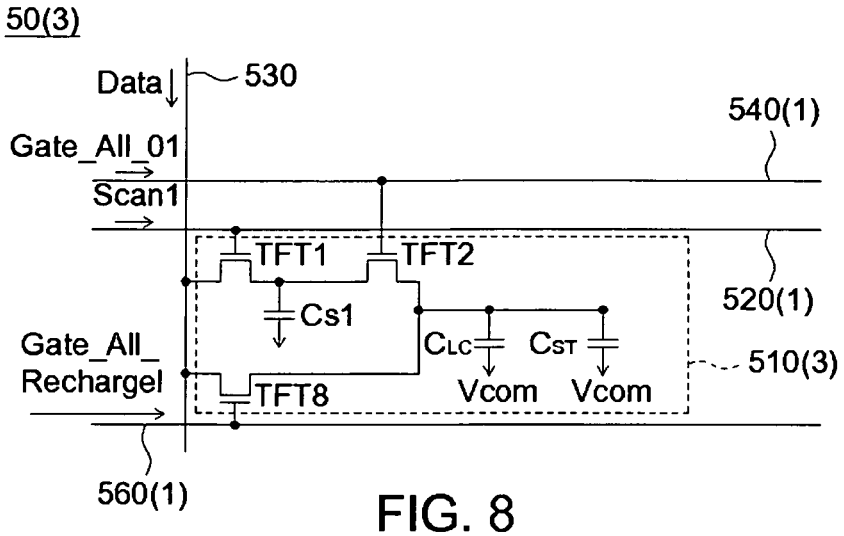
FIG. 8 is a schematic illustration of a portion of an LCD panel according to a third embodiment of the invention.

FIG. 8 is a schematic illustration of a portion 50(3) of an LCD panel according to a third embodiment of the invention. LCD panel portion 50(3) includes pixels 510(3). One difference between LCD panel 50(3) (FIG. 8) and LCD panel 50(1) (FIG. 4) is, for example, LCD panel 50(3) and pixel 510(3) respectively include signal line 560(1) and switch TFT8.

The first terminal and the second terminal of switch TFT8 are respectively coupled to the first terminal of liquid crystal capacitor $C_{LC}$ and data line 530. The control terminal of switch TFT8 is coupled to reset signal line 560(1). Switch TFT8 is controlled by reset signal Gate_All_Recharge1, transmitted via reset signal line 560(1), to make the first terminal of liquid crystal capacitor $C_{LC}$ electrically connected with corresponding data line 530. Thus, when TFT8 is enabled the crossover voltage between the first terminal and the second terminal of the liquid crystal capacitor $C_{LC}$ is reset. For example, in one embodiment of the invention the reset voltage on data line 530 is a common voltage $V_{COM}$.

Figure 9:
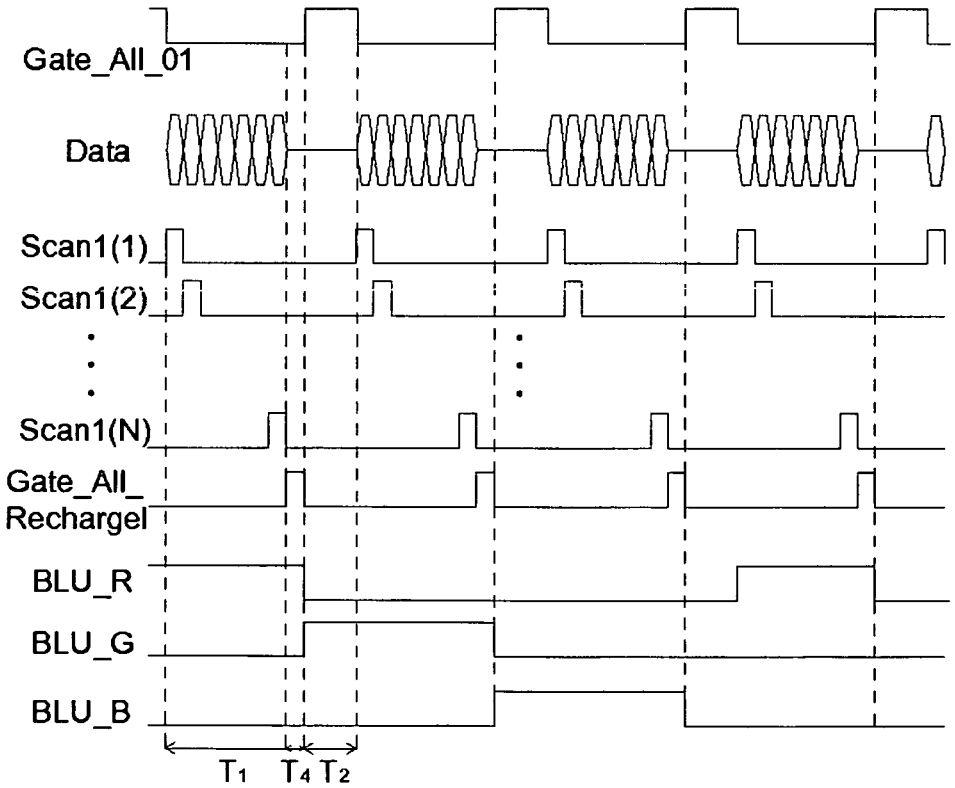
FIG. 9 is a timing diagram for an LCD panel according to the third embodiment of the invention.

FIG. 9 is a timing illustration according to an LCD panel of the third embodiment of the invention described in association with FIG. 8. Reset signal Gate_All_Recharge1, transmitted via reset signal line 560(1), synchronously (e.g., simultaneously) enables all (or multiple) switches TFT8, during time interval T4, to reset the crossover voltage between the first terminal and the second terminal of liquid crystal capacitor $C_{LC}$ of each respective pixel. Time interval T4 may occur between time intervals T1 and T2. Time intervals T2 and/or T4 may be part of, for example, a blanking period of time of the LCD device.

During time interval T4, reset voltage Vreset, transmitted via data line 530, is output to liquid crystal capacitor $C_{LC}$ via corresponding switch TFT8 to reset the crossover voltage between the first terminal and the second terminal of liquid crystal capacitor $C_{LC}$. After the first terminal of liquid crystal capacitor $C_{LC}$ and the corresponding data line 530 are electrically connected together via switch TFT8, which occurs during time interval T4, data signals of the previous frame stored in liquid crystal capacitor $C_{LC}$ and the storage capacitor $C_{ST}$ of a respective pixel 510(3) may be cleared. Therefore, the charging time for the data signal of the next frame may be shortened.

Figure 10:
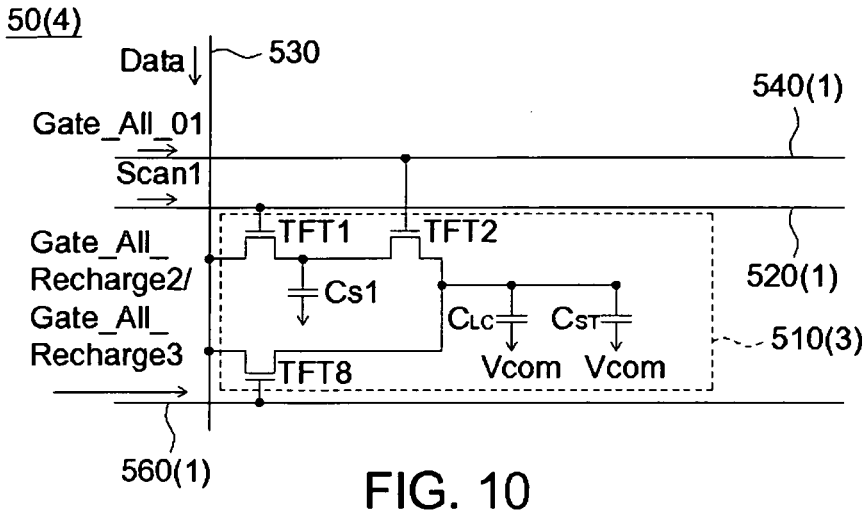
FIG. 10 is a schematic illustration of a portion of an LCD panel according to a fourth embodiment of the invention.

FIG. 10 is a schematic illustration of a portion 50(4) of an LCD panel according to a fourth embodiment of the invention. LCD panel portion 50(4) includes pixels 510(3). One difference between LCD panel 50(4) (FIG. 10) and LCD panel 50(3) (FIG. 8) is, for example, reset signal lines 560(1) are associated with odd-numbered rows (or even-numbered rows) and receive reset signal Gate_All_Recharge3 for the odd-numbered rows (or reset signal Gate_All_Recharge2 for even-numbered rows). In other words, pixels in odd-numbered rows receive reset signal Gate_All_Recharge3, transmitted via reset signal lines for the odd-numbered rows, while pixels in even-numbered rows receive reset signal Gate_All_Recharge2, transmitted via the reset signal lines for the even-numbered rows.

Figure 11:
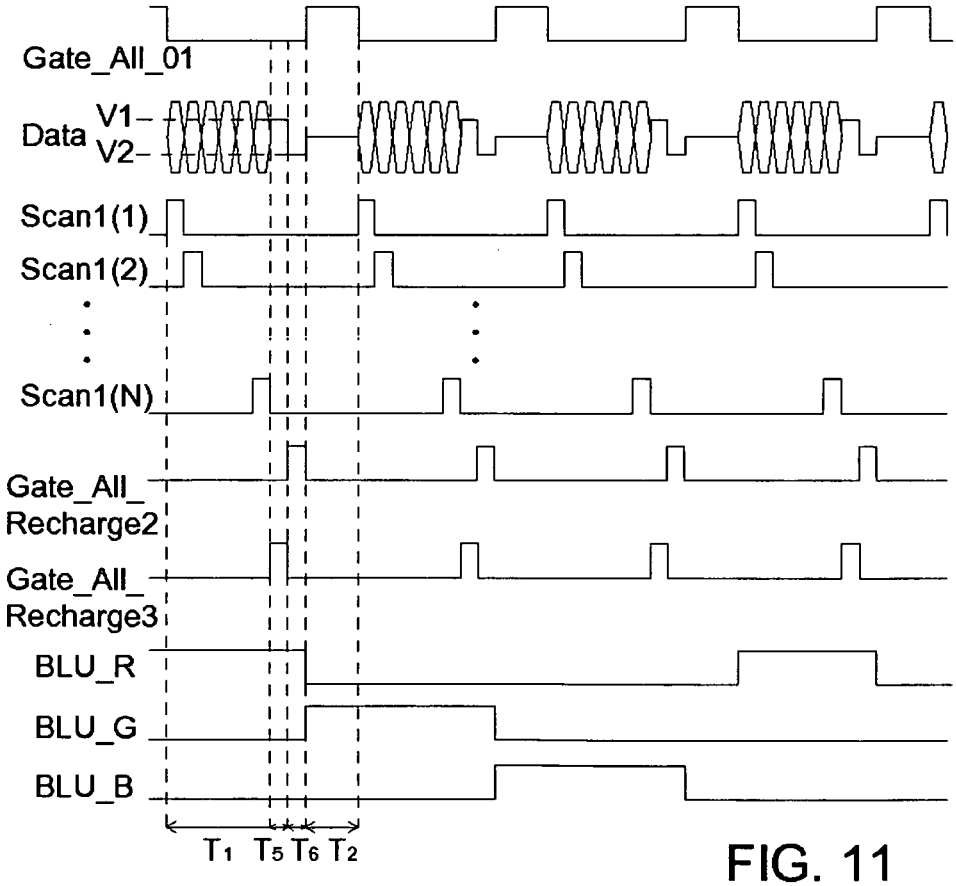
FIG. 11 is a timing diagram for an LCD panel according to the fourth embodiment of the invention.

FIG. 11 is a timing illustration for the LCD panel of the fourth embodiment of the invention described in association with FIG. 10. Reset signal Gate_All_Recharge3, transmitted via reset signal lines for odd-numbered rows, synchronously enables switches TFT8 of the odd-numbered rows of pixels during time interval T5. Reset voltage V1, on data line 530, is output to liquid crystal capacitor $C_{LC}$, via corresponding switch TFT8, to reset the crossover voltages between the first terminals and the second terminals of all (or multiple) liquid crystal capacitors $C_{LC}$ of the odd-numbered rows of pixels. After liquid crystal capacitors $C_{LC}$ of odd-numbered rows of pixels are electrically connected to data line 530, the data signals of the previous frame may be cleared according to the reset voltage V1. Because this resets the voltage between two terminals of each liquid crystal capacitor $C_{LC}$ and storage capacitor $C_{ST}$, the charging time of the data signal of the next frame may be shortened.

Reset signal Gate_All_Recharge2, transmitted via reset signal lines for the even-numbered rows, synchronously enables switches TFT8 of the even-numbered rows of pixels during a time interval T6. Also during time interval T6, reset voltage V2 on data line 530 is output to liquid crystal capacitor $C_{LC}$, via corresponding switch TFT8, to reset crossover voltages between the first terminals and the second terminals of all (or multiple) liquid crystal capacitors $C_{LC}$ of the even-numbered rows of pixels. After liquid crystal capacitors $C_{LC}$ of the even-numbered rows of pixels are electrically connected to data line 530, the data signal of the previous frame, which was previously stored, may be cleared according to the reset voltages V2 in order to reset the voltage between two terminals of each of the liquid crystal capacitor $C_{LC}$ and the storage capacitor $C_{ST}$. Thus, the charging time of the data signal of the next frame may be shortened. Time interval T2, time interval T5, and time interval T6 may, for example, each be part of a blanking period of the LCD device. Also, reset voltage V1 and reset voltage V2 may be determined according to the positive or negative nature of a frame.

Figure 12:
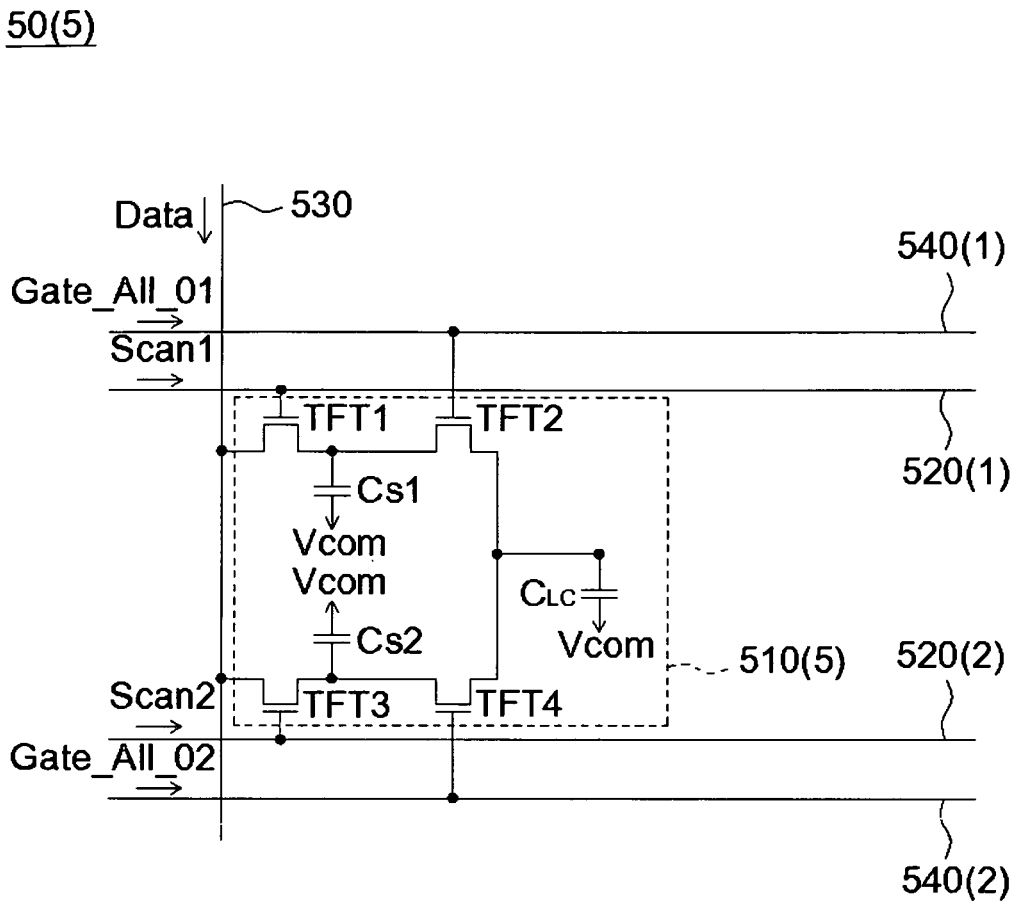
FIG. 12 is a schematic illustration of a portion of an LCD panel according to a fifth embodiment of the invention.

FIG. 12 is a schematic illustration of a portion 50(5) of an LCD panel according to a fifth embodiment of the invention. LCD panel portion 50(5) includes pixels 510(5). One difference between LCD panel 50(5) (FIG. 12) and LCD panel 50(1) (FIG. 4) is, for example, LCD panel 50(5) includes scan line 520(2) and signal outputting line 540(2). Also, pixel 510(5) includes capacitor $C_{S2}$ and switches TFT3 and TFT4. In addition, storage capacitor $C_{ST}$ is omitted from the pixel 510(5), thereby increasing the aperture ratio of display 50(5).

The control terminals of switches TFT3 and TFT4 are respectively coupled to scan line 520(2) and signal outputting line 540(2). The first terminal of switch TFT3 is coupled to data line 530 and the second terminal of switch TFT3 is coupled to the first terminals of capacitor $C_{S2}$ and switch TFT4. The second terminal of switch TFT4 is coupled to the first terminal of liquid crystal capacitor $C_{LC}$. Also, the second terminals of capacitor $C_{S1}$, capacitor $C_{S2}$, and liquid crystal capacitor $C_{LC}$ receive a common voltage Vcom (e.g., ground).

Figure 13:
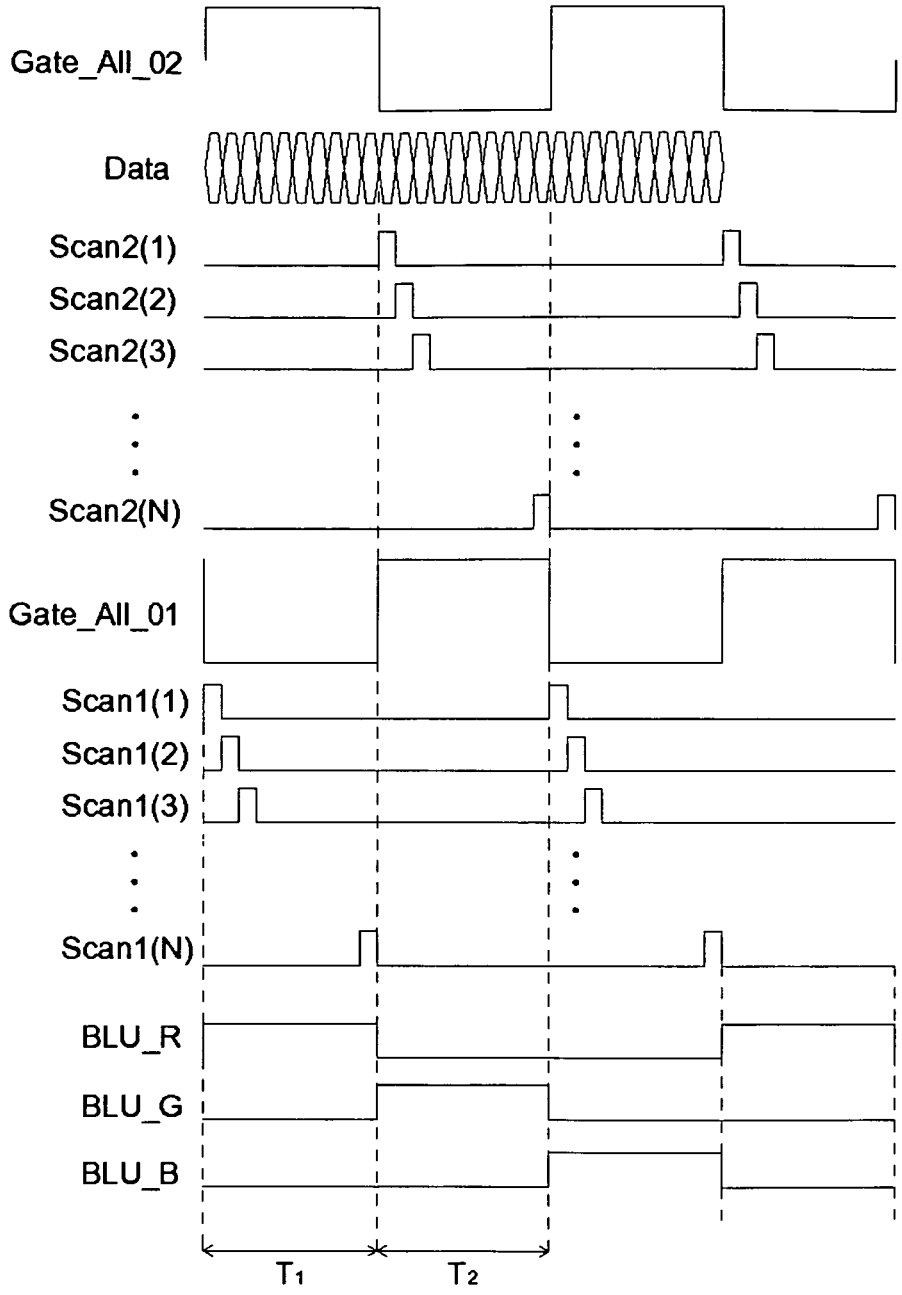
FIG. 13 is a timing diagram for an LCD panel according to the fifth embodiment of the invention.

FIG. 13 is a timing diagram according to the fifth embodiment of the invention described in association with FIG. 12. Scan driver 30 outputs scan signals Scan2(1) to Scan2(N). Scan signal Scan2 (FIG. 12) is one of the scan signals Scan1(1) to Scan1(N) (FIG. 13). Scan signals Scan2(1) to Scan2(N) respectively and sequentially enable switches TFT3 of each row of pixels 510(5), via the scan line 520(2), during time interval T2. Thus, data signal Data, transmitted via data line 530, is applied to capacitor $C_{S2}$ via a corresponding switch TFT3.

Output signal Gate_All_02, transmitted via signal outputting line 540(2), synchronously enables all switches TFT4 (or multiple switches TFT4) during time interval T1. Thus, the data signal Data, stored in capacitor $C_{S2}$, is output to liquid crystal capacitor $C_{LC}$ via corresponding switch TFT4. Time interval T2 may be part of a blanking period of the LCD device.

Switches TFT2 and TFT4 may be alternately turned on and off so data signals stored in capacitor $C_{S1}$ and capacitor $C_{S2}$ are alternately applied to liquid crystal capacitor $C_{LC}$. In one embodiment of the invention, each display period is not divided into a pixel scan section and a data display section. Consequently, light efficiency is enhanced. Nevertheless, capacitor $C_{S1}$ and capacitor $C_{S2}$ can store data signal Data, transmitted via data line 530, resulting in an increased aperture ratio for the LCD panel without using a storage capacitor in pixel 510(5).

Figure 14:
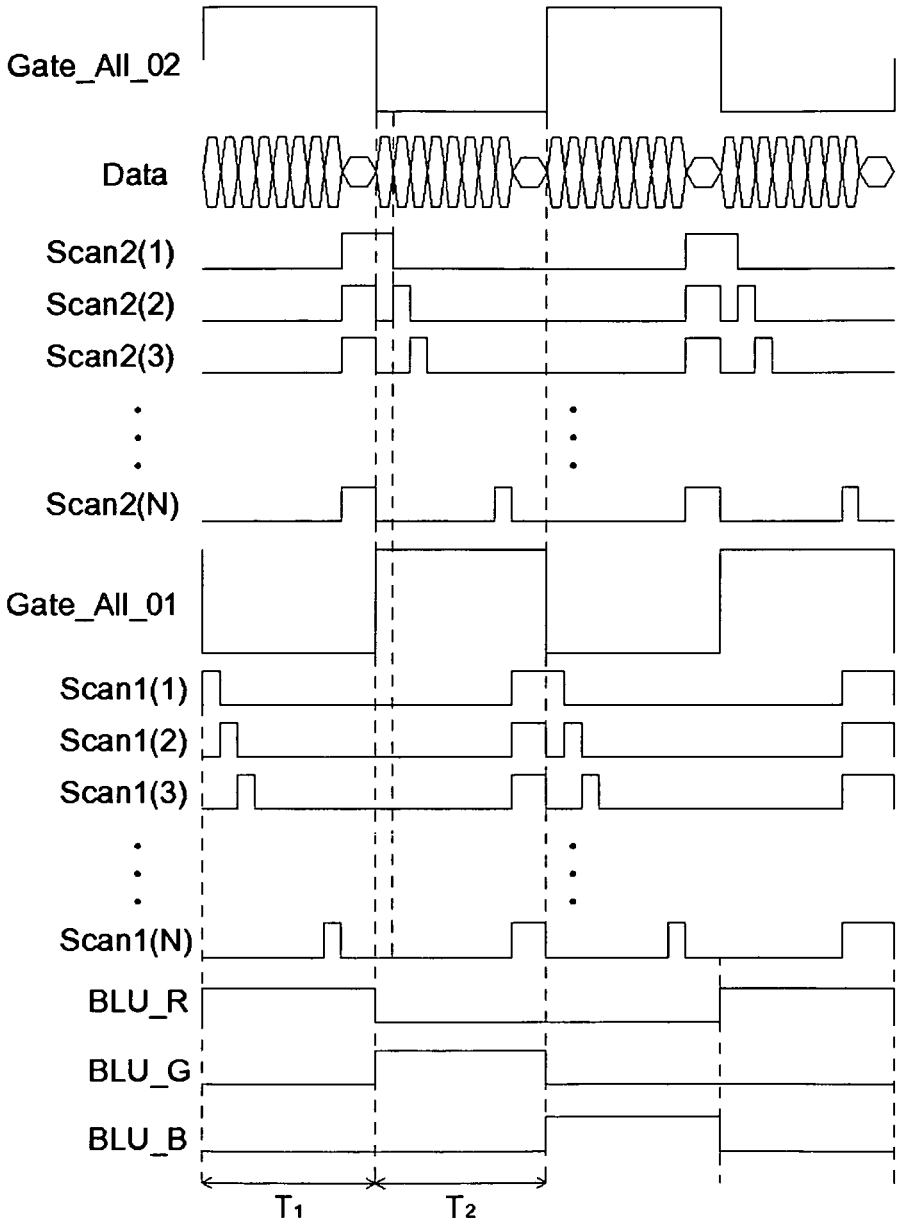
FIG. 14 is another timing diagram for an LCD panel according to the fifth embodiment of the invention.

FIG. 14 is another timing diagram according to the fifth embodiment of the invention described in association with FIG. 12. One difference between the timing diagrams of FIGS. 14 and 13 is, for example, according to FIG. 14 scan signals Scan1(1) to Scan1(N), transmitted via scan line 520(1), synchronously enable switches TFT1 during time interval T2. Thus, reset voltage on data line 530 is output to capacitor $C_{S1}$, via corresponding switch TFT1, to reset the crossover voltage between the first terminal and the second terminal of the capacitor $C_{S1}$. In addition, scan signals Scan2(1) to Scan2(N), transmitted via scan line 520(2), synchronously enable switches TFT3 during time interval T1. Thus, the reset voltage on data line 530 is output to capacitor $C_{S2}$, via corresponding switch TFT3, to reset the crossover voltage between the first terminal and the second terminal of capacitor $C_{S2}$. The reset voltage on the data line 530 may be, for example, a common voltage Vcom (e.g., ground).

Figure 15:
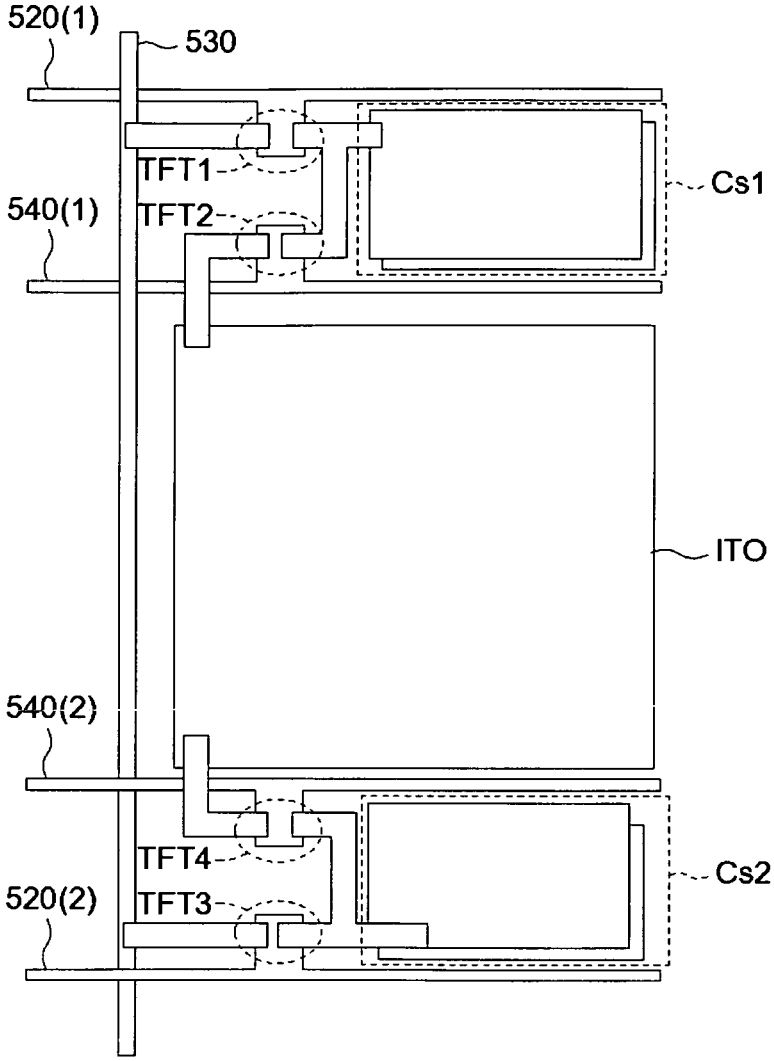
FIG. 15 is a partial circuit layout diagram for a portion of an LCD panel according to the fifth embodiment of the invention.

FIG. 15 is a partial circuit layout diagram of a portion of the LCD panel according to the fifth embodiment of the invention. Capacitor $C_{S1}$ is disposed between scan line 520(1) and signal outputting line 540(1), and capacitor $C_{S2}$ is disposed between scan line 520(2) and signal outputting line 540(2). Pixel electrode ITO is disposed between signal outputting line 540(1) and signal outputting line 540(2).

Figure 16:
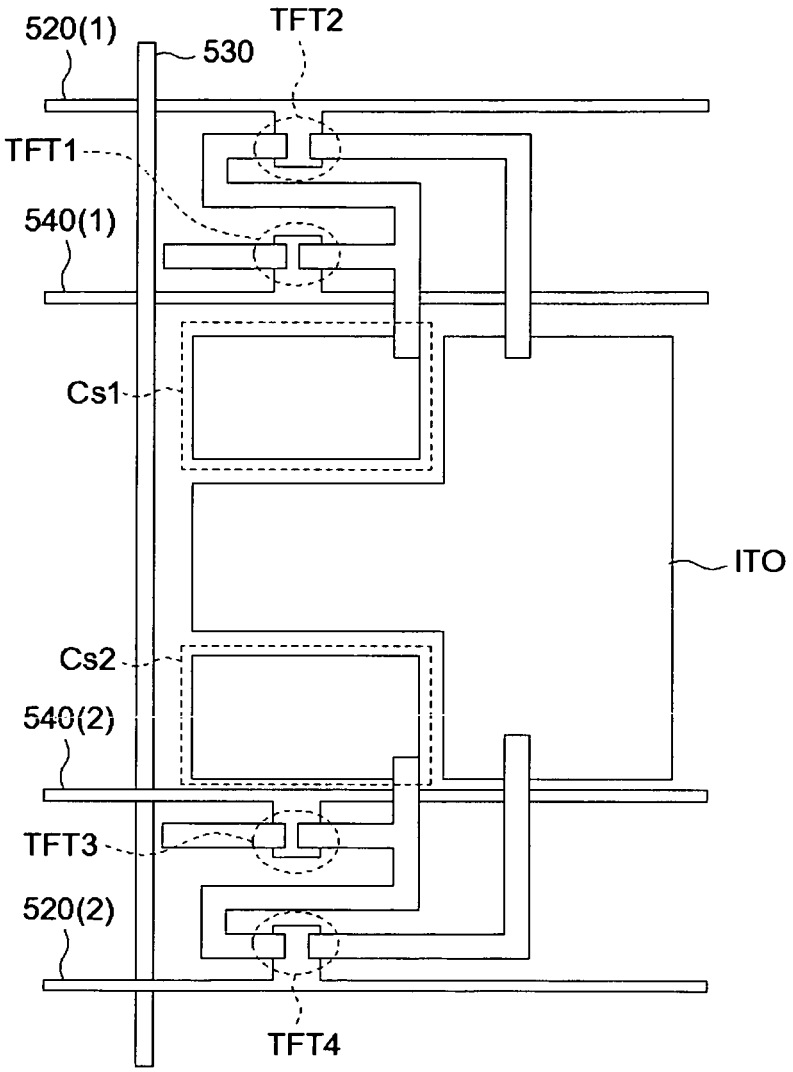
FIG. 16 is another partial circuit layout diagram for a portion of an LCD panel according to the fifth embodiment of the invention.

FIG. 16 is another partial circuit layout diagram of a portion of the LCD panel according to the fifth embodiment of the invention. Capacitor $C_{S1}$, capacitor $C_{S2}$, and pixel electrode ITO are disposed between signal outputting line 540(1) and signal outputting line 540(2).

Figure 17:
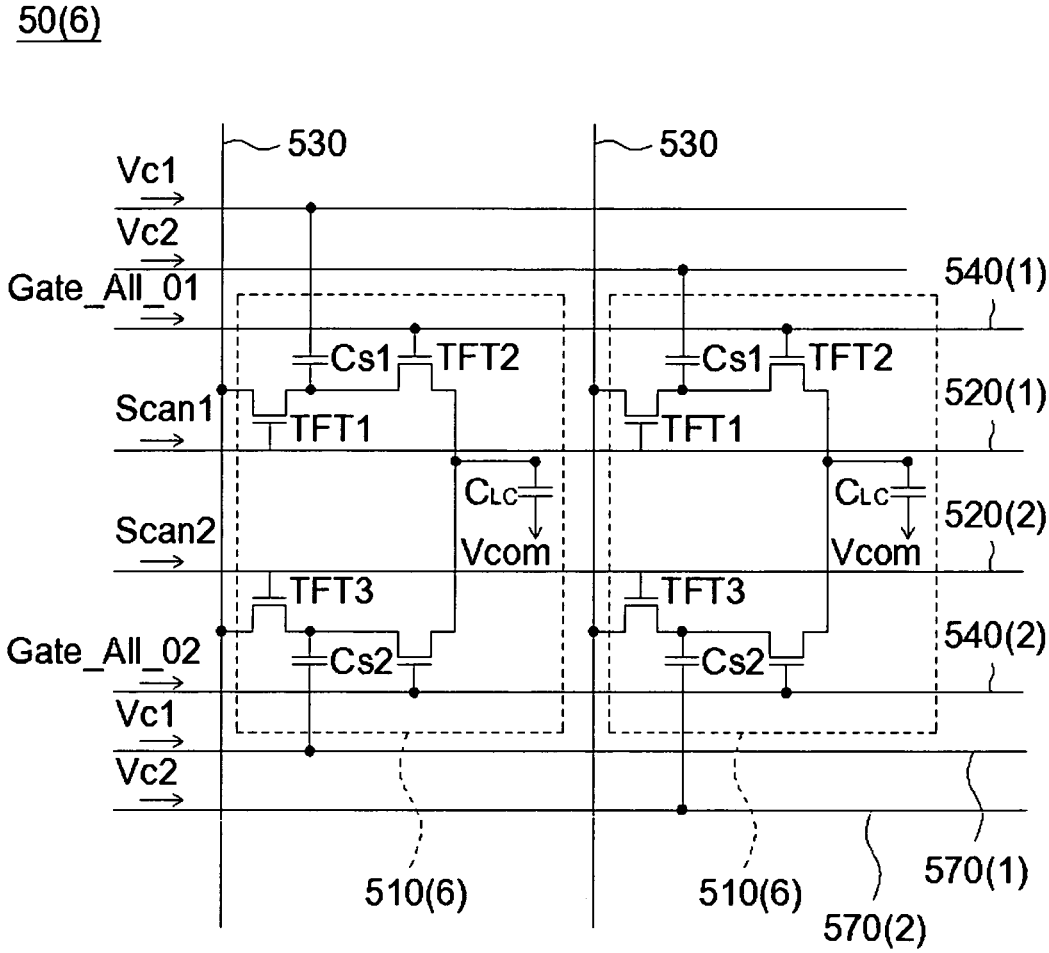
FIG. 17 is a schematic illustration of an LCD panel according to a sixth embodiment of the invention.

FIG. 17 is a schematic diagram of a portion of an LCD panel according to a sixth embodiment of the invention. LCD panel portion 50(6) includes pixels 510(6). One difference between LCD panel 50(6) (FIG. 17) and LCD panel 50(5) (FIG. 12) is, for example, LCD panel 50(6) includes bias lines 570(1) and 570(2). The second terminals of capacitors $C_{S1}$ and $C_{S2}$ of the odd-numbered columns of pixels are coupled to bias line 570(1), and the second terminals of capacitors $C_{S1}$ and $C_{S2}$ of the even-numbered columns of pixels are coupled to bias line 570(2). The second terminals of capacitors $C_{S1}$ and $C_{S2}$ of the odd-numbered columns of pixels receive bias voltage Vc1 on bias line 570(1), while the second terminals of capacitors $C_{S1}$ and $C_{S2}$ of the even-numbered columns of pixels receive bias voltage Vc2 on bias line 570(2).

Figure 18:
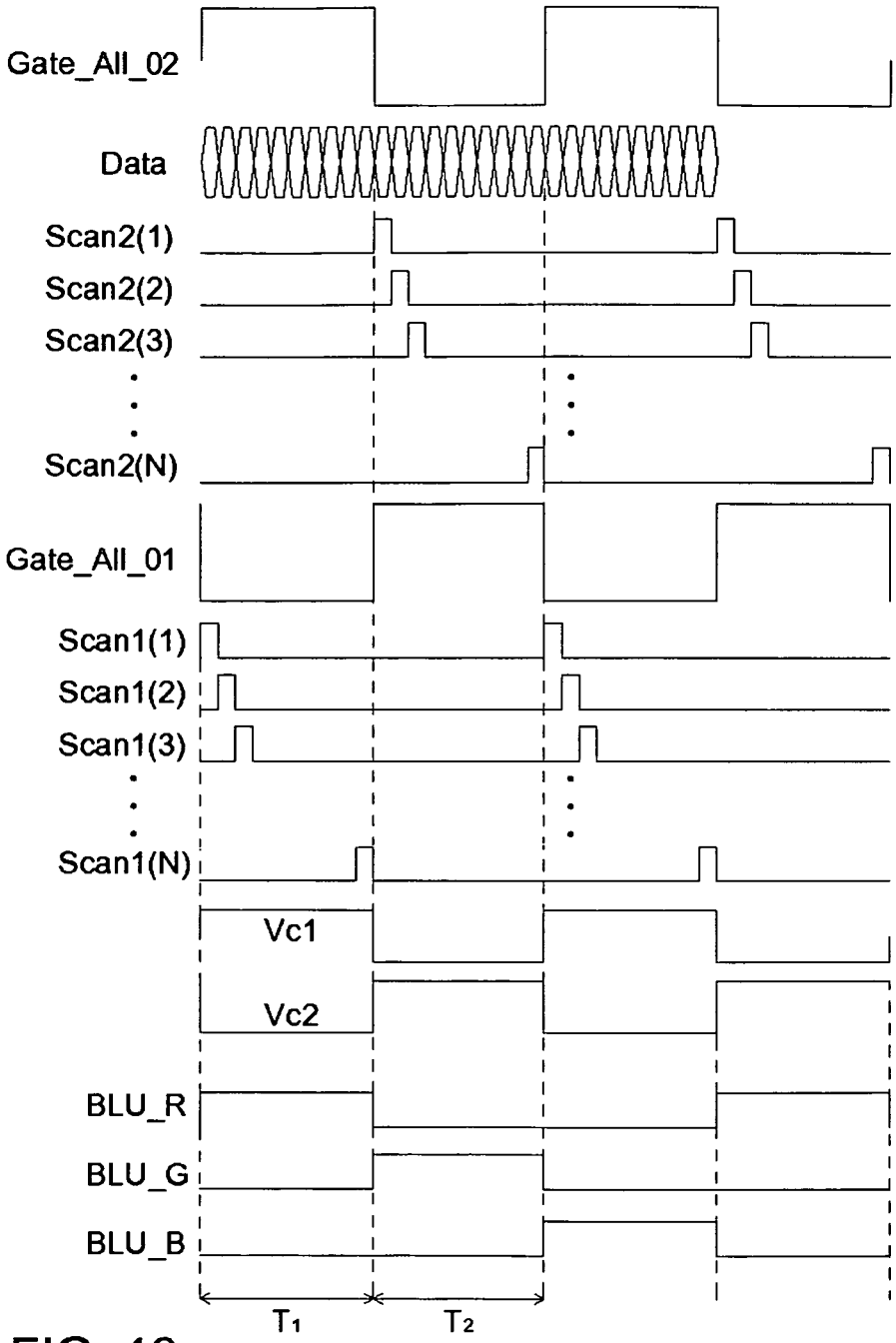
FIG. 18 is a timing diagram for an LCD panel according to the sixth embodiment of the invention.

FIG. 18 is a timing diagram according to the sixth embodiment of the invention. Bias voltages Vc1 and Vc2 are respectively lowered during time intervals T2 and T1. Thus, the crossover voltages between the first terminals and the second terminals of capacitors $C_{S1}$ and $C_{S2}$ are increased, and the charges stored in the capacitors $C_{S1}$ and $C_{S2}$ are increased.

Figure 19:
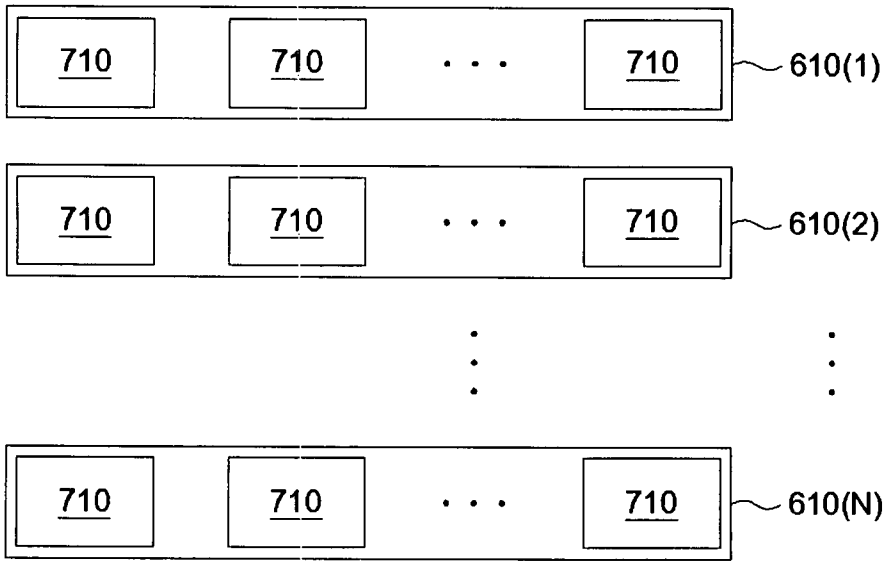
FIG. 19 is a schematic illustration of an LCD device having a scan backlight module according to an embodiment of the invention.

In addition, various embodiments of the invention work in conjunction with a scan backlight module to improve motion picture quality and display effect. FIG. 19 is a schematic illustration of an LCD device that includes a scan backlight module. Pixel 710 of the LCD device may be, for example, any pixel architecture discussed herein. In the scan backlight module, the light source is divided into N light source regions 610(1) to 610(N), wherein each region corresponds to multiple pixels 710. In the scan backlight module, light source regions 610(1) to 610(N) are respectively and sequentially turned on and off in one display frame time.

Figure 20:
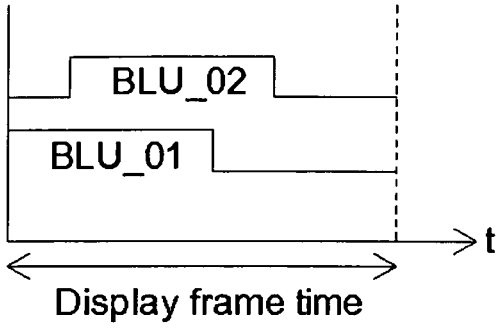
FIG. 20 is a timing diagram for a backlight module according to an embodiment of the invention.

FIG. 20, a timing diagram for the scan backlight module associated with FIG. 19, shows the operation cycle of each light source region. Signal BLU_01 and signal BLU_02 respectively enable/disable different light source regions. The operations of each light source region may include, for example, turning a region on for 50% of the frame time and turning it off for 50% of the frame time. The operations may also include, for example, turning a region on for 33% of the frame time and turning it off for 67% of the frame time.

According to various embodiments of the invention, the same number of Gate_All signals may be set in conjunction with the number of the light source regions so signals may be synchronously output to liquid crystal capacitors corresponding to the light source regions. Also, the display signals corresponding to various regions and the light source may operate synchronously.

Figure 21:
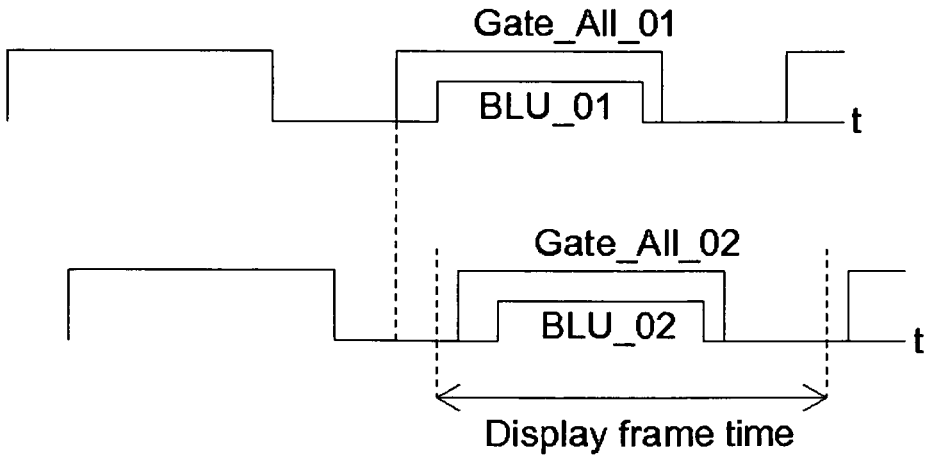
FIG. 21 is a timing diagram for a backlight module according to an embodiment of the invention.

FIG. 21 is a timing diagram for a scan backlight module according to an embodiment of the invention. Using two light source regions as an example, two corresponding signals Gate_All_01 and Gate_All_02 respectively and synchronously enable the switches in the region to output signals to the liquid crystal capacitors. Also, two light source regions are respectively turned on according to the signals BLU_01 and BLU_02. Thus, various embodiments of the invention can improve phase delay phenomenon, which occurs between turning a light source on and the display signal. The phenomenon may be caused by different scanning orders.

Accordingly, an LCD panel and LCD device can synchronously output data signals to the liquid crystal capacitors, and thus reduce the influence of the delayed liquid crystal response on the displayed frames. Pixels can consequently reach a desired brightness more easily.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for operating a liquid crystal display (LCD) device comprising:

during a first time period, applying first data from a data line to a first capacitor included in a pixel and applying additional data from the data line to an additional first capacitor included in an additional pixel;

during a second time period, which follows the first time period, simultaneously applying the first data to a liquid crystal (LC) capacitor included in the pixel and the additional data to an additional LC capacitor included in the additional pixel;

during a third time period, applying a first reset voltage to the LC capacitor to reset preexisting data stored in the LC capacitor; and during a fourth time period, applying a second reset voltage to the additional LC capacitor to reset additional preexisting data stored in the additional LC capacitor;

wherein the second time period is a data blanking period, and the third time period and the fourth time period are non-overlapping with each other, the voltage polarity of the first reset voltage is opposite to the voltage polarity of the second reset voltage, and the first reset voltage is applied to one of odd numbered rows or even numbered rows and the second reset voltage is applied to the other of odd numbered rows or even numbered rows in a frame.

2. The method of claim 1, further comprising applying the first data to the first capacitor before applying the additional data to the additional first capacitor.

3. The method of claim 1, wherein: the first data is applied to the first capacitor based on enabling a switch included in the pixel; and the first data is applied to the LC capacitor based on enabling an additional switch included in the pixel.

4. The method of claim 3, wherein:

the first reset voltage is applied from the data line to the LC capacitor via another switch included in the pixel in the third time period; and the second reset voltage is applied from the data line to the additional LC capacitor via a switch included in the additional pixel in the fourth time period;

wherein the third time period and the fourth time period precede the second time period.

5. The method of claim 3, further comprising applying a bias voltage to the pixel during the first time period.

6. The method of claim 1, further comprising:

illuminating the pixel with a back light unit of a first color during the first time period; and illuminating the pixel with a back light unit of a second color during the second time period.

7. A liquid crystal display (LCD) device comprising:

a first pixel including a first capacitor, a first liquid crystal (LC) capacitor, a first switch, a second switch, and a third switch;

a second pixel including a second capacitor, a second LC capacitor, a fourth switch, a fifth switch, and a sixth switch; and a data line coupled to the first pixel and the second pixel;

wherein, during a first time period, the data line is to apply (a) data to the first capacitor via the first switch and (b) additional data to the second capacitor via the fourth switch; during a second time period, the data is to be applied to the first LC capacitor via the second switch while the additional data is to be applied to the second LC capacitor via the fifth switch; during a third time period, a first reset voltage is applied to the first LC capacitor via the third switch for resetting preexisting data stored in the first LC capacitor; and during a fourth time period, which is non-overlapping with the third time period, a second reset voltage is applied to the second LC capacitor via the sixth switch for resetting additional preexisting data stored in the second LC capacitor, and the voltage polarity of the first reset voltage is opposite to the voltage polarity of the second reset voltage, and the first reset voltage is applied to one of odd numbered rows or even numbered rows and the second reset voltage is applied to the other of odd numbered rows or even numbered rows in a frame.

8. The device of claim 7, wherein:

the third switch is coupled to the data line to apply the first reset voltage to the first LC capacitor during the third time period and the sixth switch is coupled to the data line to apply the second reset voltage to the second LC capacitor during the fourth time period, the third and fourth time periods to precede the second time period.

9. A liquid crystal display (LCD) device comprising:

a data line to sequentially apply, during a first time period, data to a capacitor included in a pixel and additional data to an additional capacitor included in an additional pixel; and a liquid crystal (LC) capacitor included in the pixel to receive the data and an additional LC capacitor included in the additional pixel to receive the additional data during a second time period;

wherein preexisting data stored in the LC capacitor is to be cleared based on applying a first reset voltage to the LC capacitor during a third time period while additional preexisting data stored in the additional LC capacitor is to be cleared based on applying a second reset voltage to the additional LC capacitor during a fourth time period, and the third and fourth time periods, which are non-overlapping with each other, precede the second time period, and the voltage polarity of the first reset voltage is opposite to the voltage polarity of the second reset voltage and the first reset voltage is applied to one of odd numbered rows or even numbered rows and the second reset voltage is applied to the other of odd numbered rows or even numbered rows in a frame.

10. The device of claim 9, wherein:

the data line is to apply the data to the capacitor based on a switch included in the pixel being enabled; and the LC capacitor is to receive the data based on an additional switch included in the pixel being enabled.

11. The device of claim 10, wherein when preexisting data stored in the LC capacitor is to be cleared, another switch included in the first pixel is enabled, and when additional preexisting data stored in the additional LC capacitor is to be cleared, a switch included in the additional pixel is enabled.

12. The device of claim 10, wherein the first reset voltage is applied from the data line to the LC capacitor via another switch included in the pixel.

* * * * *